United States Patent [19]

Schmidt

[11] 4,019,350

[45] Apr. 26, 1977

[54] METHOD OF PRODUCING DOUBLE-KNIT FABRIC HAVING ADDITIONAL FLEECE THREADS INCORPORATED INTO ONE FACE OR BOTH FACES THEREOF

[75] Inventor: Walter Richard Schmidt, Breisach am Rhine, Germany

[73] Assignee: Burlington AG, Switzerland

[22] Filed: Mar. 18, 1974

[21] Appl. No.: 452,358

[30] Foreign Application Priority Data

Mar. 19, 1973 Germany ..... 2313651
Feb. 18, 1974 Germany ..... 2407736

[52] U.S. Cl. ..... 66/196; 66/19
[51] Int. Cl.[2] ..... D04B 9/26
[58] Field of Search ..... 66/196, 197, 200, 19, 66/20, 25, 198, 194

[56] References Cited

UNITED STATES PATENTS

| | | | |
|---|---|---|---|
| 693,409 | 2/1902 | Leighton | 66/194 |
| 777,048 | 12/1904 | Scott | 66/194 |
| 3,264,846 | 8/1966 | Pfrommer | 66/196 |
| 3,422,638 | 1/1969 | Widdowson et al. | 66/19 |
| 3,672,186 | 6/1972 | Rab | 66/25 |
| 3,808,843 | 5/1974 | Blore et al. | 66/196 |
| 3,874,197 | 4/1975 | Plath | 66/194 X |

FOREIGN PATENTS OR APPLICATIONS

| | | | |
|---|---|---|---|
| 349,728 | 6/1931 | United Kingdom | 66/196 |
| 404,970 | 1/1934 | United Kingdom | 66/200 |
| 441,024 | 1/1936 | United Kingdom | 66/197 |
| 455,047 | 10/1936 | United Kingdom | 66/197 |

OTHER PUBLICATIONS

Wignal, *Knitted Outerwear Times*, Feb. 9, 1970, vol. 39, No. 6, pp. 54–57.

*Primary Examiner*—Mervin Stein
*Assistant Examiner*—Andrew M. Falik
*Attorney, Agent, or Firm*—Cushman, Darby & Cushman

[57] ABSTRACT

The present invention provides a method of producing double-knit goods or fabrics having additional fleece threads incorporated into one face or both faces thereof and a nap or fleece is imparted from these threads by napping. The method comprises feeding the backing or ground yarn only to the needles of both needle sets (dial and cylinder) which are fully raised for stitch formation, while feeding the additional fleece thread to the needles of one needle-set (cylinder) which form stitches and tuck loops, and/or feeding the backing yarn and the additional fleece thread in successive steps of operation and knitting them into common stitches on one needle set (dial) and into stitches and tuck loops on the other needle set (cylinder).

16 Claims, 12 Drawing Figures

METHOD OF PRODUCING DOUBLE-KNIT FABRIC HAVING ADDITIONAL FLEECE THREADS INCORPORATED INTO ONE FACE OR BOTH FACES THEREOF

The present invention relates to a method for the incorporation of additional fleece threads into one face or both faces of double-knit goods or fabrics for the production of a raised pile by napping. Fabrics of this type may be used for all kind of upperwear and underwear, furniture fabrics, cover and laid-in fabrics, blankets and the like.

In double-knit fleece fabrics, it is necessary to process (knit) at least two thread systems in combination whereby one thread system forms a resistant base or backing fabric while the other system forms loose stitches for napping.

In the known method carried out on interlock or fine rib circular knitting machines the additional fleece thread is inserted or fed into the needle heads of one set of needles (cylinder) while it is laid, by the greater raising stroke of the other needle set (dial), behind the latch of these needle onto the needle shaft. After all needles have been withdrawn (retracted) into the feeding position, the backing yarn is fed, and stitches are formed from both threads on one needle set (cylinder). In this way, the additional fleece thread is formed into thread or yarn loops over the needle shafts of the other needle set (dial). These loops are released by the subsequent knitting of the fed backing yarn so as to provide the reverse of thread which is required for the napping operation in finishing the fabric.

For the production of double-thread stitches on one side of the fabric of double-face knit goods, two further possibilities are known:

The first possibility is the one-face plating of a double-face fabric. Hereby, the base yarn is fed to the needles of both needles beds, while the plating or laid-in thread is fed to the needles of one needle set, which needles then form common stitches from both threads. In view of the fact that stitches knitted in one-face fashion are always smaller, i.e. stronger, than two-face stitches, in a napping operation the base yarn but not the plaited thread is destroyed. Since only the base yarn was formed into stitches on the other side of the fabric, these stitches are disintegrated in the case of complete destroyal of the base yarn, thereby rendering the fabric unuseful.

The same disadvantages result in another conventional knitting method (German Pat. No. 896,252). The threads knitted into common stitches in two successive operations likewise form single thread stitches on the opposite side of the fabric such that they are also disintegrated when the thread is destroyed.

Therefore, the requirements for the production of a double-knit raised pile fabric can only be fulfilled in the method described at the beginning since the fleece thread is knitted into common stitches with the backing only and since it is substantially more loose (less dense) than the backing yarn due to the loops formed over the needle shafts of the other needle set (dial). Therefore, in the customary napping process the fleece thread is engaged first and raised. In order to obtain a dense fiber pile, the fleece thread may also be torn without thereby damaging the fabric. This becomes possible for the reason that the fleece or additional plated in thread does not form any independent stitches.

Disadvantages of this method reside in that there are required for the formation of the thread loops of the fleece thread, an additional or auxiliary needle raising, a precisely adjusted special yarn carrier and the operation with delayed timing, i.e. that the stitch formation of one needle set is effected later than that of the other needle set, so that an independent patterning of the base yarn and of the fleece thread is not possible. If, for example, a tuck loop is to be formed from the fleece thread, a stitch must be formed from the backing yarn at the same time.

Accordingly, it is the object of the present invention to form the thread loops of the fleece thread by normal tuck loops, which operation can be effected independently of the backing yarn and does not require any additional needle movements.

The solution of this object comprises feeding the backing yarn only to the needles of both needle sets which are fully raised for stitch formation, while feeding the additional fleece thread to the needles of one needle set (cylinder) which form stitches and tuck loops, and/or feeding the backing yarn and the fleece thread in successive steps of operation and knitting them into common stitches on one needle set (dial) and into stitches and tuck loops on the other needle set (cylinder).

The advantages obtained by the invention can be seen in that the formation of the tuck loops of the fleece thread is substantially independent of the loop formation from the backing yarn, such that the number of the tuck loops may be selected irrespectively of the number of stitches of the base yarn, i.e. such tat a Jacquard patterning is rendered possible. Another advantage resides in the fact that the needles provided for the formation of double thread stitches may be selected by a patterning device, so-called Jacquard attachments, too. The two aforementioned solutions according to the invention permit to knot a base yarn on each of both sides of the fabric into stitches in combination with a fleece thread each, whereas the fleece threads form a predetermined number of tuck loops independently from each other, i.e. that each side of the fabric may be patterned as desired. On the other hand, each embodiment along offers the possibility of knitting fleece threads into both sides or faces of the fabric; however, this can be effected in an alternating manner only.

Exemplary embodiments of the invention are shown in the drawings and are explained in greater detail below. In the drawings.

Figure 3:
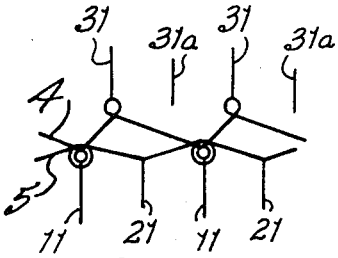
FIGS. 3 and 4 illustrate interlacement possibilities for the backing yarn and the fleece thread.
Figure 5:
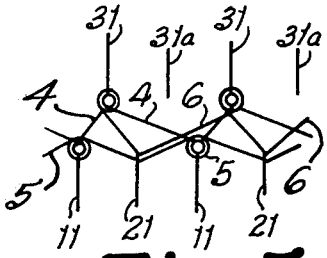
FIG. 5 illustrates a possibility of plating a pair of additional fleece threads threads on each side of the fabric by means of a backing yarn.
Figure 7:
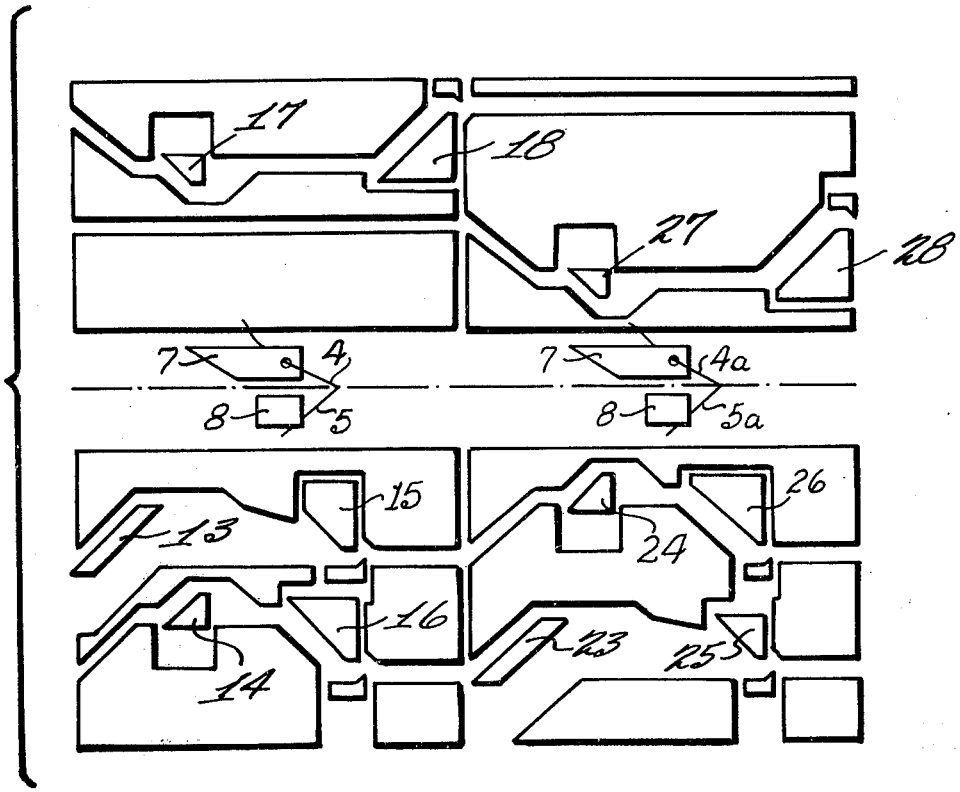
FIGS. 7 and 9 illustrate portions of the cylinder and rib cams of circular knitting machines according to the invention.
Figure 9:
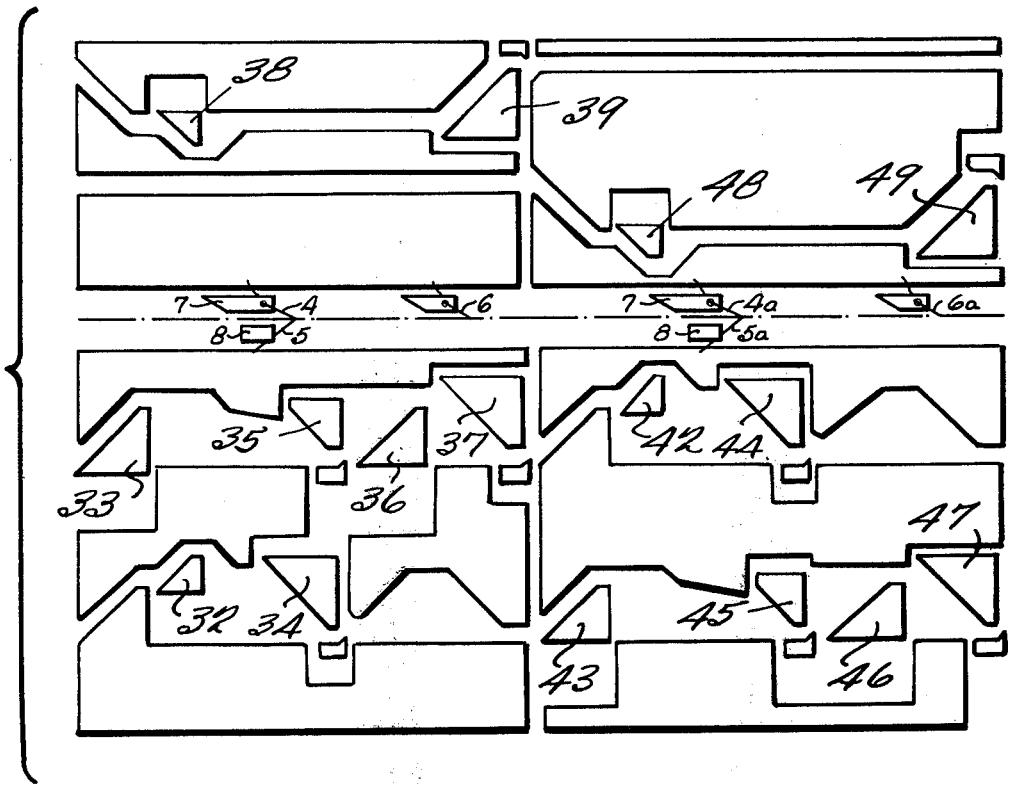
Figure 10:
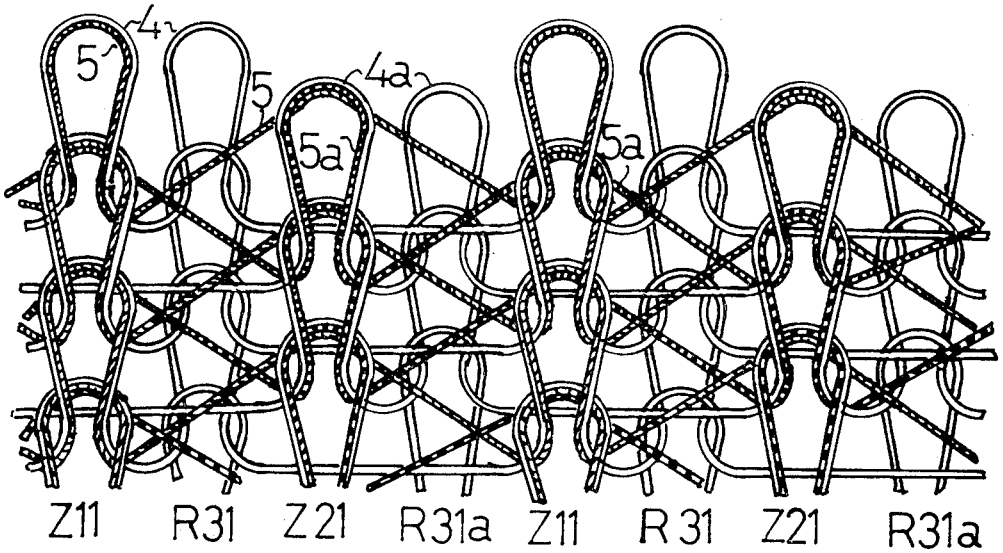
Figure 11:
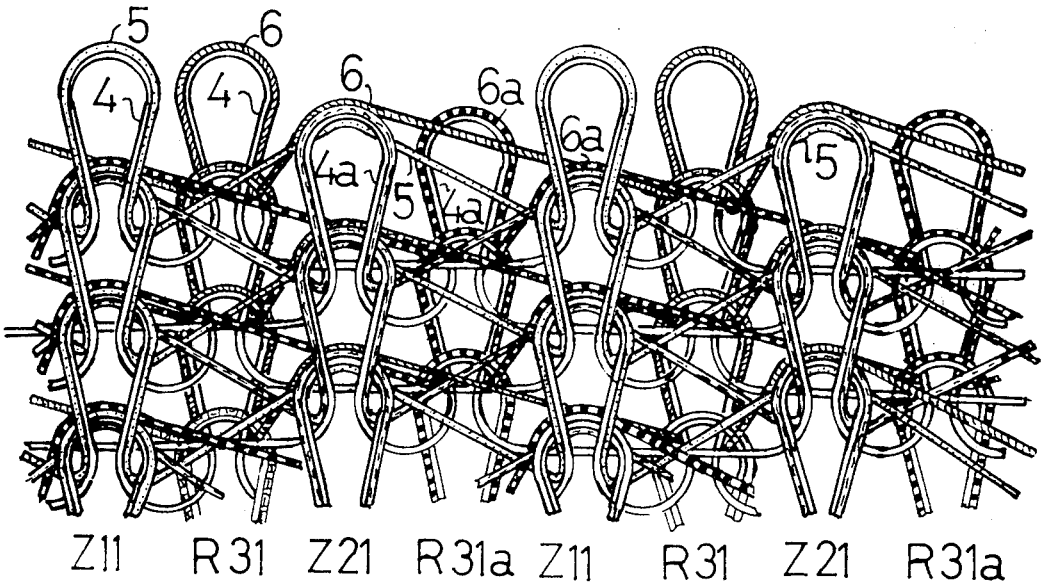
Figure 12:
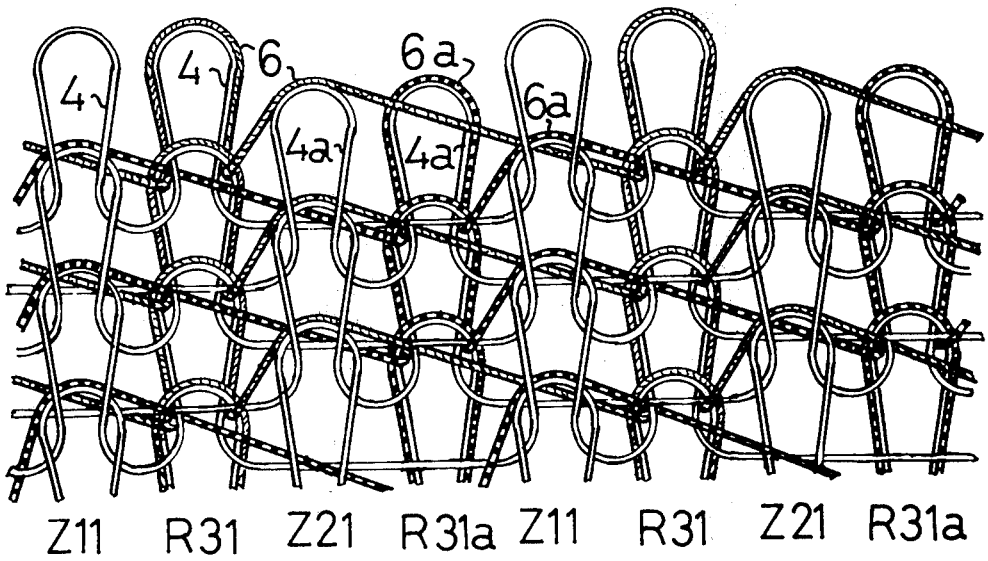

FIG. 10 shows a stitch pattern according to FIGS. 3 and 7, FIG. 11 shows a stitch pattern according to FIGS. 5 and 9, and FIG. 12 shows a stitch pattern with the fleece yarn 6 alone.

Figure 1:
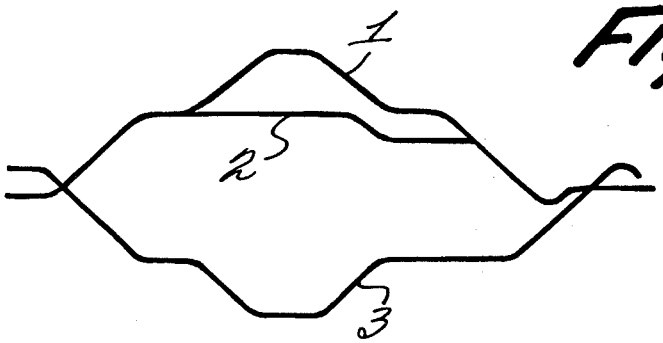
FIG. 1 shows a motion diagram of cylinder and dial needles for processing a fleece thread on one side of the fabric.

FIG. 1 illustrates a diagram of movement of cylinder and dial needles. Preferably, every second needle 11 in the cylinder is fully raised, such that this needle follows the curve indicated at 1. As illustrated by curve 2, all of the other cylinder needles 21, or in the case of a Jacquard selection a portion of the remaining cylinder needles 21 which is contemplated to be used for patterning, are moved up to the tuck position. In the dial, either all needles 31 and 31a or, as is customary in the so-called twill back (bird's eye), alternating needles 31 or 31a are raised for stitch formation (curve 3). After in all of the fully raised cylinder and dial needles the stitches have passed onto the needle shaft behind the needle latches (knitting position), the needles are retracted into the feeding position. The cylinder needles 21 left in the tuck position are likewise retracted slightly so that in the feeding position the needles forming the stitches or tuck loops, respectively, are at different levels.

The hook of the withdrawn tuck cylinder needle 21 should protrude as little as possible beyond the plane of the dial needle 31 in order to provide maximum certainty for the separate feeding and processing of the backing yarn 4. However, the cylinder needle 21 must be positioned high enough such that the fleece thread 5 may be fed without difficulty. Preferably, this cylinder assumes a position which the needle 12, which has previously been moved into the knitting position, has reached in FIG. 2. As the cylinder needle 21 was formerly in the tuck position only, the needle hook of cylinder needle 21 remains open and is not closed by its needle latch in contrast with cylinder needle 12 which is closed by its needle latch.

If this movement of the tuck cylinder needles 21 were dispensed with, the backing yarn 4 would have to be fed over cylinder needles 21 to the cylinder needles 11 and 12 already in the knitting position of the latter. This would necessitate a very precise adjustment of the yarn carrier, whereby it could presumably not be prevented anyhow that in the feeding position, i.e. when all cylinder needles are positioned in one level, the backing yarn 4 is always disposed behind the cylinder needles 21. Due to the fact that the backing yarn 4 could move into the needle hooks also over the needle heads, this would result in faults.

Figure 2:
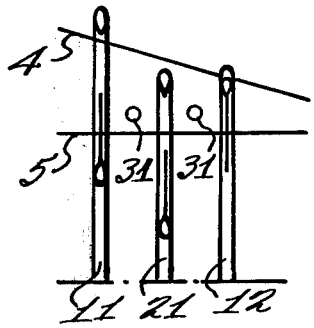
FIGS. 2 and 8 show the position of dial and cylinder needles with the feeding of the backing yarn and the fleece thread in accordance with the example shown in FIG. 1.

FIG. 2 shows the position of cylinder needles 11, 12 and 21, and of dial needles 31 after the feeding of the base yarn 4 and of the fleece or additional plaited yarn 5. Cylinder needles 11 and 12, and dial needles 31 have been previously raised into the clearing position and have been retracted into the feeding position in accordance with and as shown by curves 1 and 3 of FIG. 1. As shown by curve 2, the cylinder needles 21 have been raised into the tuck position and have been subsequently slightly withdrawn or retracted in order to obtain maximum clearance between the needle heads of needles 11 and 21 as shown incurve 2 of FIG. 1. The backing yarn 4 is fed exclusively to the stitch-forming cylinder needles 11 and 12 which are not a higher position. The fleece thread 5 is fed underneath the dial needles 31, which thread is engaged both by the cylinder needles 11 and 12 raised for stitch formation and by cylinder needles 21 brought into the tuck position. By the lowering of the cylinder needles into the cast-off position, needles 11 and 12 form common stitches from the backing yarn and from the fleece thread, while the needle 21 forms only the fleece thread into tuck loops.

By knitting the fleece thread 5 on the cylinder only (jersey course), a greater stitch length must be set at the stitch cam than normally required for the synchronized formation of stitches on the dial and on the cylinder (double-knot course).

Therefore, if the cylinder needles 11, 12 and 21 knitted the backing yarn 4 and the fleece thread 5 and the dial needles 31 knited only the backing yarn 4 in synchronized timing, a relatively too slack basic fabric would result from the backing yarn 4.

Thus, it is expedient to perform the stitch formation of dial needles 31 only after the cylinder needles 11 and 12 or 21, respectively (delayed timing), in order to obtain a sufficiently tight basic fabric.

The thread reserve of the fleece thread 5 which is required for the massing operation, is provided by the formation of tuck loops, whereby each stitch should be connected to a tuck loop. If every second needle is used for stitch formation, this can be readily obtained.

A patterning of the nap or fleece effected by selection of the remaining needles in the tuck position. If no tuck loop is formed, the stitches of the fleece or additional plated thread are directly interconnected by a welt stitch, so that they are relatively tight and are not raised by the teasels of the napping machine. The tuck loop should be formed as large as possible in order to provide sufficient reserve thread. Therefore, it would be advantageous if it were possible to adjust the knock over depths of stitches and tuck loops independently, in order to sink the tuck loops at a deeper position than the stitches, if necessary. As a solution to this problem, the use of long and short needles having separate stitch cams offers itself, as is customary, among others, on interlock and eightlock knitting machines as well as for forming twill reverse sides in the dial of every Jacquard attachment.

FIG. 3 illustrates the interlacement of the backing yarn 4 and the fleece thread 5 in a course of stitches, whereby every second needle has been used for stitch formation in the dial.

Figure 4:
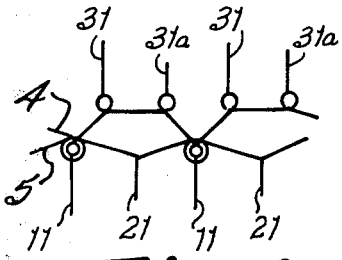

In contrast, all of the dial needles have been raised in FIG. 4.

A fleece or additional plated fabric adapted to be napped on both sides thereof is obtained by exchanging the above-described functions of the dial and cylinder needles in any desired sequence and feeding the fleece or additional plated threads to the cylinder and dial needles in accordance with such sequence. A double-face patterning by selecting the tucking needles is only possible if the dial and the cylinder are provided with separate patterning means, so-called Jacquard attachments.

FIG. 5 illustrates the interlacement of a fleece thread 5 on one side of the fabric and that of another fleece thread 6 on the other side, by means of the same base yarn 4. In this way, exclusively stitches of the backing yarn 4 and fleece threads are formed on both sides of the fabric, and a maximum high pile by napping is obtained on each side. As shown in FIG. 5, the tuck loops of both fleece threads 5 and 6 are formed on the same needle jet (cylinder) by needles 21.

Figure 6:
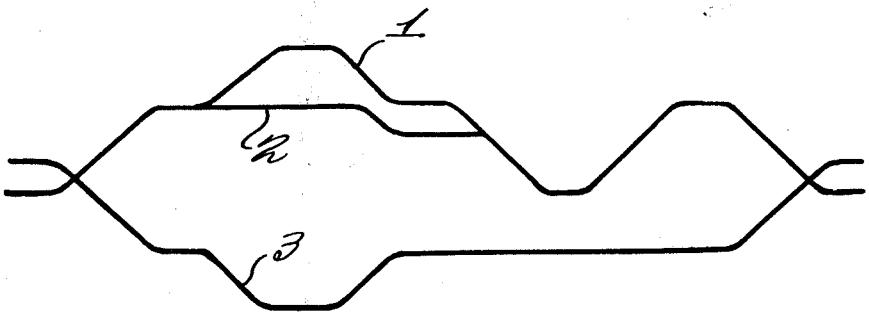
FIG. 6 shows a motion diagram of the cylinder and dial needles for producing the fabric shown in FIG. 5 as well as for the incorporation of a fleece thread on one side of the fabric.

FIG. 6 illustrates a diagram of movement of the cylinder and dial needles for producing the fabric described in connection with FIG. 5. As shown by curve 1, alternating cylinder needles are brought into the knitting position while the remainder of the needles or a selected number thereof are moved into the tuck position as indicated by curve 2. Preferably, in the dial every second needle is brought into the knitting position (curve 3), too.

After all needles have been raised into the clearing and feeding position as described with respect to FIG. 1, and after backing yarn 4 and fleece yarn 5 have been fed, all cylinder needles and retracted into the cast-off position. As described in lines 14–18 of page 8, every second cylinder needle 11 knits stitches from both yarns, while all intermediate needles 21 or selected intermediate needles knit tuck loops therebetween from the additional plaited yarn 5 only. On the other hand, the dial needles with the backing yarn 4 fed thereto are retained in the feeding portion until all cylinder needles or selected cylinders needles, respectively, are raised into the tuck position and the fleece thread 6 has been fed by a normal feeder. Thereafter, all rib and cylinder needles in action are brought into the cast-off position. Now, the dial needles form common stitches from the backing yarn 4 and from the fleece thread 6, while the cylinder needles form tuck loops from the fleece thread 6 exclusively.

As the two fleece threads 5 and 6 form their tuck loops at the cylinder needles 21 only, both sides of the fabric may be patterned with the patterning attachments which are normally provided at the cylinder, by selection of the tucking needles.

Another embodiment of the invention for the production of double-knit goods having a fleece thread incorporated into one face thereof comprises to incorporate the fleece thread 6 only as shown in FIGS. 5 and 6. As the backing yarn 4 and the fleece thread 6 are fed in separate steps of operation, it is not necessary to raise cylinder needles into the knitting and tucking position during the first step of operation. Curve 2 of the tuck needles as shown in FIG. 6 can be omitted. Therefore, in the first step of operation all needles, alternate or selected needles in the dial and in the cylinder brought into the knitting position (FIG. 6; curves 1 and 3) and thereafter retracted into the feeding position. The backing yarn 4 is fed and knitted into stitches by the needles of the cylinder only (curve 1). The needles of the dial which remain in the feeding position (curve 5) retain this position even in the second step of operation until all or selected cylinder needles have been brought into the tuck position and the fleece thread 6 has been fed. Thereafter, all operated needles of dial and cylinder are brought into the castoff position. The dial needles form common stitches from the backing yarn 4 and from the fleece thread 6, while the cylinder needles form tuck stitches from the fleece thread 6.

The patterning of a fabric produced in this manner is effected either by selection of the cylinder needles which are moved into the tuck position for receiving the fleece yarn 6, or by selection of the dial needles which form common stitches from both yarns. Since patterning attachments (Jacquard attachments) are usually provided in circular knitting machines on the cylinder only, the cylinder needles must be guided in accordance with curve 3 and the dial needles must be guided in accordance with curve 1 of FIG. 6. If the functions of the dial needles and cylinder needles are exchanged in any desired sequence, there is also formed a fleece fabric adapted to be napped on both faces thereof.

In comparison with the embodiment described in connection with FIG. 1, the last-described embodiment offers the advantage that in the first step of operation needles of both needle sets are brought into the knitting position exclusively, such that the backing yard 4 may be fed in the customary manner. In the second step of operation, the fleece thread is likewise fed to both needle sets by the customary yarn carrier. Therefore, it is possible in this exemplary embodiment to exchange the backing yarn 4 and the fleece thread 6 as described through stripers.

The separate feeding of both yarns necessitates greater space requirements as compared with the example described in connection with FIG. 1. If necessary, the feeding of the backing yarn 4 and of the fleece thread 6 can be effected in two successive knitting systems. In order to guide the needles of e.g. the dial in the feeding position into the second knitting system (feed), the stitch cam in the first system (feed) and the cams in the second system (feed) must be formed correspondingly, i.e. the stitch cam loses its function as a stitch forming portion and is shortened into a guiding cam.

FIG. 7 shows a schematical view of two dial and cylinder feeders cams of a circular knitting machine for carrying out the method in accordance with the invention. Preferably, the dial and the cylinder are equipped with short needles and long needles in alternating fashion. These needles provide for an independent control of the knitting and of the tucking needles as well as for a varied adjustment of the lengths of the stitches and tuck loops.

Another advantage of this solution resides in the fact that the Jacquard attachment need not select all of the three known needle positions, i.e. welting, tucking and knitting, which would result in an increased expenditure and greater space requirements for the Jacquard attachment, but merely brings the needles selected thereby into the tuck position. Hereby, for example, the selectors of the respective knitting needles may be brought into the inoperative position by a corresponding pattern butt.

Figure 8:
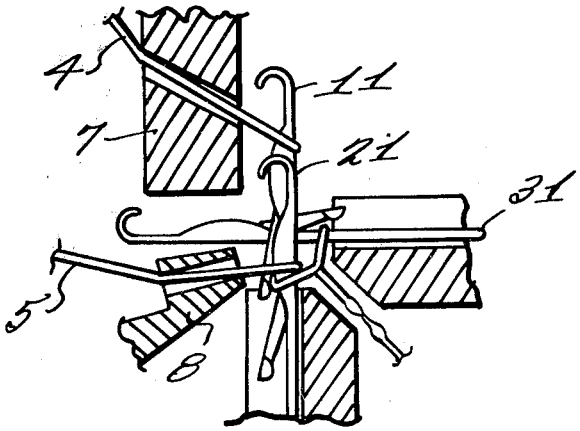

In the first knitting system (feed), the long dial needles 31 are brought into the knitting position by the raising cam 17, the long cylinder needles 11 are brought into the knitting position by the raising cam 14, and the short cylinder 21 needles are brought into the tuck position by the raising cam 13. Thereafter, the raised needles assume the feeding position as shown in FIG. 8. The yarn carrier 7 inserts the backing yarn 4 into the needles 11 only, whereas the fleece thread 5 is fed by the yarn carrier 8 to all the opened cylinders needles below the dial needles, i.e. to needles 11 and 21.

The stitch cam 16 moves the long cylinder needles 11 into the cast-off position whereby stitches are formed from the fleece thread 5 and from the backing yarn 4, and the backing yarn 4 is securely laid onto the dial needles 31 which remained in the feeding position. At the same time with the long cylinder needles 11, the stitch cam 15 moves the short cylinder needles 21 into the cast-off position, and these needles form tuck loops with the fleece thread 5 only. The stitch cams 15 and 16 should each hold a pair of needles in the cast-off position in order to prevent withdrawal of the threads from the already formed stitches or tuck loops. Thereafter, the long dial needles 31 are brought into the cast-off position by the stitch cam 18, i.e. it is operated with delayed timing, whereby a tight basic fabric is formed.

Thereupon, the short cylinder needles 21 in the second system (feed) are controlled in a manner analogous to the control of the long cylinders needles 11 in the first system. Hereby, cam 23 assumes the function of cam 13, cam 24 takes over the function of cam 14, etc. Upon passing through two feeds, all cylinder and dial needles have formed a stitch. A patterning by selecting the tucking cylinder needles can be effected by an additional or auxiliary Jacquard attachement. Hereby, the tuck raising cams 13 and 23, respectively, are inactivated. The function of these cams is then performed by the patterning attachment.

If the above-described mode of operation of the dial and cylinder needles is varied from one system or feed to the other or in any desired sequence, a fabric produced thereby can be napped on both faces thereof. However, a patterning of both faces is only possible if the dial and the cylinder are provided with patterning attachments, i.e. Jacquard attachments.

FIG. 9 shows part of the cam construction for a machine which knits on each face of the fabric a fleece thread in combination with a backing 4 according to FIGS. 5 and 6.

In the first system, the long rib needles are moved into the knitting position by the raising cam 38 and the long cylinder needles 11 are moved into the knitting position by the raising cam 32, while the short cylinder needles 21 are brought into the tuck position by the raising cam 33. Hereupon, the needles assume their feeding position according to FIG. 8, and the base yarn 4 and the fleece or additional plaited thread 5 are fed, and the cylinder needles are moved into the cast-off position by stitch cams 34 and 35. The dial needles are maintained in the feeding position. In the illustrated example FIG. 5, the short cylinder needles 21 are again raised into the tuck position, which operation could involve also all cylinder needles or the long cylinder needles 11 only, and the fleece thread 6 is fed to the dial and cylinder needles in the customary manner.

Then, the stitch cam 37 retracts the cylinder needles and the stitch cam 39 retracts the dial needles into the cast-off position. Hereby, the dial needles 31 form common stitches from the backing yarn 4 and from the fleece thread 6, while the short cylinder needles form tuck loops. In the FIG. 5 example, these needles have processed or knitted the fleece thread 5 ad the fleece thread 6 into tuck loops. As these threads form their common stitches with the base yarn 4, but independently from each other, on the cylinder (fleece thread 5) and on the dial (laid-in thread 6), by selection of tucking needles both faces of the fabric can be patterned by means of the Jacquard attachments which are normally provided on the cylinder.

In the second system (or feed) shown, the short dial needles 31a and short cylinder needles 21 operate in the same manner as the long needles 31 and 11 in the previously described system. The function of cam 32 is taken over by cam 42, that of cam 33 is taken over by cam 43, etc.

For patterning purposes by selection of tucking needles the tuck cams 33 and 36 or 43 and 46, respectively, are inactivated selectively or commonly, and their function is taken over by Jacquard attachments. Hereby, the following possibilities exist:

The Jacquard selecting is effected only on the selector jacks of the tucking needles, while the selector jacks of the knitting needles are inactivated. The selected selector jacks raise their needles into the tuck position instead of the tuck cams 33 and 36 or 43 and 46, respectively. Ultimately, both faces of the fabric show the same pattern, but they may be knitted in separate colors.

Another possibility consists in activating, with the same selecting as before, either the tuck cams 33 and 43 or the tuck cams 36 and 46. These cams make the Jacquard sorting ineffective, and the respective face of the fabric remains unpatterned.

If no needles are put into operation either for the base thread 4 and/or for the fleece or additional plated thread 6, one face or both faces of the fabric are plated by the respective fleece or additional plated thread.

An independent patterning of both sides of the fabric by means of a Jacquard attachment on the cylinder only is obtained by the following mode of operation:

According to the invention, the selecting of one face of the fabric is effected on the needles tucking the fleece thread 5, while the selector jacks of the knitting needles perform the sorting for the tucking of the fleece thread 6. This selecting does not become effective in the feeding of the backing yarn 4 and of the fleece thread 5 because it is rendered ineffective by the movement of the needles into the knitting position by means of the raising cams 32 and 42, respectively. The selecting for the fleece thread 5 is inactivated (cancelled) after the processing of this thread. Thus, for the tie-up or interlacement of the fleece thread 6, only the selecting provided to this end can be brought into the tuck position.

While the fleece thread 5 is formed into tuck loops e.g. by short needles 21, the tuck loops of the fleece thread 6 are formed on long needles 11, and vice versa.

Therefore, corresponding stitch cams have to be provided in the cylinder cam.

As already described in connection with FIG. 6, if a backing yarn and a fleece thread 6 are knitted in two successive steps of operation, in the cylinder cam according to FIG. 9 one needle track can be omitted; for example, the cam track of the short needles formed by cams 33, 35, 36, 37, 42 and 44 is omitted. The cams 32 and 34 are then provided in the second feed in the place of cams 43 and 45, while cams 46 and 47 have to be provided in the first feed.

In addition to the stitch courses according to the invention as described, stitch courses formed in the customary manner on one or both needle sets may be knitted in any desired sequence in order to form the fabric in consideration of given requirements such as elasticity, hand and the like.

What I claim is:

1. A method of producing an improved double-knit fabric comprising a backing fabric having additional threads incorporated into at least one face thereof by a first and a second set of needles, said method comprising the steps of: feeding a backing yarn to predetermined needles of said first and second set of needles for stitch formation of the backing fabric, feeding at least one additional yarn to the hooks of knitting and tucking needles of said first set of needles, wherein the backing yarn is fed only to predetermined needles within said first and second set of needles raised into clearing position above the needles of the first needle set which are in tuck position, and wherein the additional yarn is fed to all needles in knitting and tucking position of said first set of needles at the back side opposite to the hook openings of said second set of needles.

2. The method according to claim 1, wherein for obtaining a firm base fabric, such fabric is formed with a delayed timing.

3. The method according to claim 1, wherein after feeding and knocking-over said at least one additional and said backing yarn on the first set of needles said needles of said second set of needles are kept in feeding position until all or predetermined ones of said needles of the first set of needles are raised into tuck position and a second additional yarn is fed, whereupon said needles of said second set of needles form double-thread stitches.

4. A method according to claim 3 wherein in predetermined ones of courses of stitches said needles are lowered into a cast-off position.

5. The method according to claim 1 further including the step of knitting double-thread stitches from said backing yarn and said additional yarn by raising only every second needle within said first set of needles into a knitting position.

6. The method according to claim 1 further including the step of independently moving stitch forming needles and tucking needles to different sinking depths by independent stitch cams.

7. A method for producing double-knit fabrics from a backing yarn and at least one additional yarn on a circular knitting machine having first and second sets of needles which method comprises successively feeding at least one additional yarn and at least one backing yarn to both sets of needles; retracting the needles of a first set of needles for stitch formation after said backing yarn has been fed to said needles of said first and second sets of needles; simultaneously holding at least predetermined ones of needles of a second set of needles inn a feeding position with said backing yarn in their hooks, thereby preventing said needles of said second set of needles from stitch formation; thereafter raising at least said needles of said first set of needles into tucking position; and thereby engaging said additional yarn by said needles of said first set of needles; whereby all or predetermined ones of said needles of said first set of needles are only raised into tuck position in order to prevent the stitch of said backing yarn on said needles of said first set of needles to slide on the needle shaft behind the needle latch and to cause said additional yarn to form tuck loops instead of stitches after retraction of said needles into cast-off position.

8. The method according to claim 7, wherein said needles of said first and said second set of needles are retracted into cast-off position simultaneously without delayed timing after feeding the additional yarn.

9. The method of claim 7, wherein the functions or steps of operation of said first set of needles and said second set of needles are exchanged predetermined courses of stitches.

10. A method according to claim 7, wherein in predetermined ones of courses of stitches said needles are lowered into a cast-off position.

11. A method of producing an improved double-knit fabric comprising a backing fabric having additional threads incorporated in at least one face thereof, using a first and second group of needles wherein the first and second groups of needles each have first and second sets of needles, said method comprising the steps of:

raising said first set of needles within said first group of needles to a clearing position;

raising the second set of needles in said first group of needles into a tuck position;

raising said first set of needles in said second group of needles to a clearing position;

thereafter feeding a backing yarn to at least the first set of needles in said first and second groups of needles; subsequently feeding at least one additional yarn to said first and second sets of needles within said first group of needles;

retracting said first and second sets of needles within said first group of needles so as to form stitches on said first set of needles from the backing yarn and said at least one additional yarn while simultaneously forming tuck loops from said additional yarn on said second set of needles;

retracting said first set of needles within said second group of needles so as to form stitches of said backing yarn thereon;

whereby the backing yarn is formed into stitches within said first and second groups of needles thereby forming a backing fabric while said at least one additional yarn is formed into alternating stitches and tuck loops within at least said first group of needles.

12. A method according to claim 11 wherein prior to retracting said first set of needles within said second group of needles the method comprises the additional steps of raising the second set of needles within said first group of needles to a tucking position, thereafter feeding a second additional thread to the first set of needles within the second group of needles and to said second set of needles within said first group of needles raised to a tuck position and then retracting said second set of needles within said first group of needles along with the retraction of said first set of needles within the second group of needles so that when all the needles are retracted, double stitches are formed at said first set of needles within said second group of needles and tucks are again formed at this second set of needles within said first group of needles.

13. A method according to claim 12 wherein said first set of needles within said first group of needles comprises every second needle within said first group of needles.

14. A method according to claim 11 wherein the stitches comprising the base fabric are formed by delayed timing.

15. A method according to claim 11 wherein said stitch and tucking needles are retracted to different sinking depths independently from one another so that the length of material being drawn by the respective needles will vary according to the sinking depth of said needles, so that stitches and tuck stitches of different length are formed.

16. A method for producing an improved double-knit fabric from a backing fabric having additional yarns knit therewith on a circular knitting machine having a first and a second group of needles, said first and second groups of needles each having a first and second sets of needles, said method comprising the steps of positioning the first sets of needles within said first and second groups of needles into a clearing position, placing said second set of needles within said first group of needles into a tucking position but retracted slightly from the height of said first sets of needles of said first group of needles, feeding a backing yarn to said first sets of needles within said first and second groups of needles, subsequently, separately feeding a first additional yarn to said first set of needles and said second set of needles within said first group of needles, retracting the first group of needles for stitch formation in knock-over position after said backing yarn and said first additional yarn have been fed to said first and second groups of needles while simultaneously holding said first set of needles within said second group of needles in a feeding position with said backing yarn being in the hooks of said needles, thereby preventing said first set of needles within said second group of needles from forming stitches, thereafter raising said second set of needles within said first group of needles into a tuck position and then feeding a second additional yarn to said first set of needles within said second group of needles and to said second set of needles within said first group of needles, and subsequently retracting the first set of needles in said second group of needles and the second set of needles in said first group of needles so that a common stitch from backing and second additional yarn is knitted on the first set of needles in the second group of needles and an additional tuck loop is formed on the second set of needles of said first group of needles.

* * * * *